US006153285A

United States Patent [19]

Christel et al.

[11] Patent Number: 6,153,285

[45] Date of Patent: Nov. 28, 2000

[54] INDENTATION IN A PLASTICALLY DEFORMABLE MATERIAL

[75] Inventors: Werner Christel, Hambach; Horst Drescher, Werneck, both of Germany

[73] Assignee: Mannesmann Sachs AG, Schweinfurt, Germany

[21] Appl. No.: 09/197,818

[22] Filed: Nov. 23, 1998

[30] Foreign Application Priority Data

Nov. 22, 1997 [DE] Germany ..... 197 51 918

[51] Int. Cl.[7] ..... B32B 3/00

[52] U.S. Cl. ..... 428/156; 428/167; 428/212

[58] Field of Search ..... 428/156, 167, 428/141, 212

[56] References Cited

FOREIGN PATENT DOCUMENTS

| | | |
|---|---|---|
| 0563781 A1 | 10/1993 | European Pat. Off. . |
| 24 82 484 | 11/1981 | France . |
| 69 305 | 6/1892 | Germany . |
| 20 20 868 | 11/1971 | Germany . |
| 42 36 961 | 5/1994 | Germany . |
| 195 01 792 | 8/1996 | Germany . |

OTHER PUBLICATIONS

Article entitled "Werkzeuge zum Fertigen von Versteifungssicken" written by Winfried Petzold taken from Bänder Blecke Rohre, dated Apr. 1991, pp. 37–40.

Article entitled "Optimierte Herstellung und Versteifungswirkung von geschlossenen Halbrundsicken" written by Dr.–Ing. M. Widmann taken from Blech Rohr Profile 32, dated 1985, pp.1235–131.

Article entitled "Some recent advances in microwave reflector antennas" written by Prof. P.J.B. Clarricoats taken from Proceedings of the Institute of Electrical Engineers, vol. 126, No. 1, dated Jan. 1979, pp. 9–25.

*Primary Examiner*—Donald Loney

*Attorney, Agent, or Firm*—Cohen, Pontani, Lieberman & Pavane

[57] ABSTRACT

An indentation in a surface of a plastically deformable material, in particular metal, having a curved section at the base of the indentation. The curved section is adjoined in the direction of the surface by a further section which has the shape of a parabola in cross section.

6 Claims, 1 Drawing Sheet

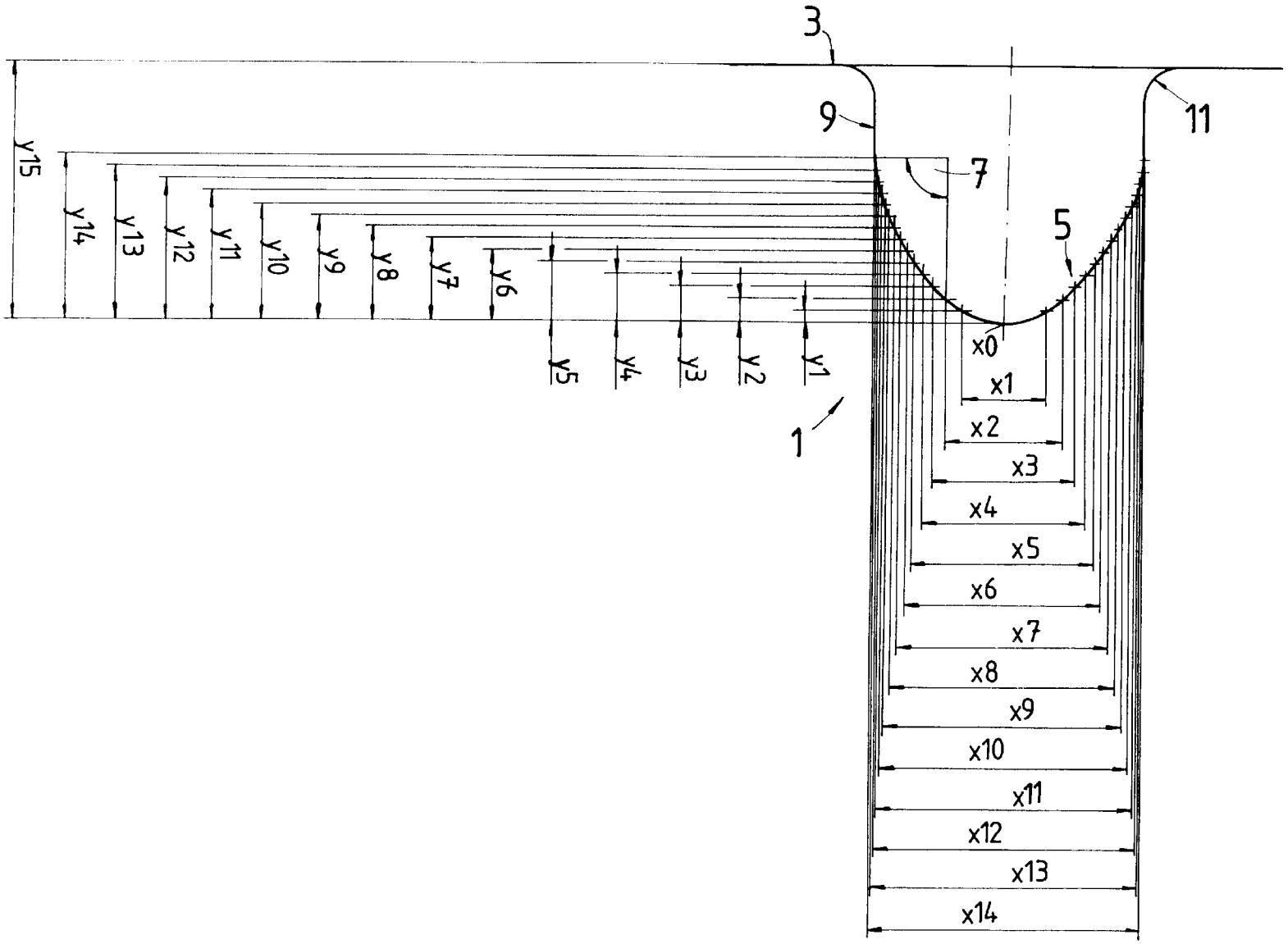
11
5
7
3
9
1
x0
x1
x2
x3
x4
x5
x6
x7
x8
x9
x10
x11
x12
x13
x14
y1
y2
y3
y4
y5
y6
y7
y8
y9
y10
y11
y12
y13
y14
y15

INDENTATION IN A PLASTICALLY DEFORMABLE MATERIAL

BACKGROUND OF THE INVENTION

1. Field of the Invention

The invention relates to an indentation in a plastically deformable material.

2. Discussion of the Prior Art

French reference FR 2 482 484 discloses an indentation in the form of a bead in a pipe body, which has an essentially rectangular cross section. Beads of this type can have only a relatively slight depth, since otherwise cracks would occur.

German references DE 20 20 868 and DE-PS 69 305 describe methods which can be used to produce an indentation of relatively great depth which has a curved base to the indentation. The base of the indentation is of semicircular design, as a result of which the width of the indentation turns out to be relatively large.

In some applications, however, the indentation must have a great depth in conjunction with a slight width. An example of this is known from German reference DE 42 36 961, in which an indentation is part of a fire protection means for a vibration damper. The required depth of the indentation is also determined by the wall thickness of the piston ring of the vibration damper. It must be ensured that the indentation can come to bear against the top side of the piston. Particularly in the case of injected or laminated piston rings such as are known from German reference DE 195 01 792, an indentation must be rings such as are known from German reference DE 195 01 792, an indentation must be particularly deep, but also narrow, since the width of the indentation is to be regarded as lost length for the stroke of the vibration damper.

SUMMARY OF THE INVENTION

It is the object of the present invention to realize a geometry for an indentation which permits a great depth in conjunction with a slight width, the aim being to minimize the formation of cracks.

According to the invention, this object is achieved by virtue of the fact that the curved section is adjoined in the direction of the surface by a further section which has the shape of a parabola in cross section. The curved base of the indentation prevents cracks from forming at this point. The further parabolic section permits the displaced material to start a flowing movement which likewise counteracts the risk of cracks, but permits a favorable ratio of the depth of the indentation to the width of the indentation.

With regard to a particularly deep indentation, the parabolic section is adjoined by a cylindrical section in the direction of the surface. Comprehensive experiments have shown that once a material starts a flowing movement it can also be subjected to such a strong forming movement that a cylindrical section is permitted.

In order additionally to counteract the formation of cracks, at its transitions to neighboring sections, the parabolic section in each case has the same gradient as the gradient thereof. The indentation has a continuous contour in the mathematic sense.

If the measurement capabilities of the user allow, the curved section has a parabolic cross section at the base.

In this case, the parabolic section has at the base a smaller gradient factor than the adjoining parabolic section. In the first parabolic section, a relatively large amount of material is displaced by flowing and can "flow further" on the indenting tool in the direction of the surface of the workpiece. The larger the wedge angle of the indenting tool at the apex of the base of the indentation, the less cracks are formed at this point.

The indentation profile is designed such that the indentation can be of punctiform design or designed as a bead.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWING

The FIGURE is an enlarged view of an indentation pursuant to the present invention.

DETAILED DESCRIPTION OF THE PREFERRED EMBODIMENTS

The FIGURE shows an enlargement of an indentation 1 in a surface 3 of a body which consists of a plastically deformable material, for example sheet metal. The indentation can be divided into a plurality of sections. Firstly, there is a base 5 which has an apex $x_0$ with the coordinates 0/0. A semicircular shape or a parabolic shape in accordance with the equation $y=m_1 (x_1/2)^2$ can be optionally selected for the base, which extends from the apex as far as the width $x_1$ (m=gradient factor). The decision regarding the shape of the base depends on the production capabilities of the indenting tool. A semicircular shape is easier to produce and, above all, to check precisely in the case of a small dimension $x_1$.

Starting from about the measurement width $x_2$, there is a second section 7, which has a parabolic shape, the gradient factor $m_2$ of the second section 7 being larger than the gradient factor $m_1$ of the first parabola or the semi-circular shape. Both sections have the same gradient at the transition point, with the result that there is a continuous transition without bends. The second section 7 is determined by the measurement widths $x_2$ to $x_{14}$, the elevation points $y_i$ starting from the apex $x_0$ being intended to illustrate the relationship of the second section 7.

The second parabolic section 7 merges into a cylindrical section 9 of constant width. Embossed at the upper outlet of the indentation toward the surface 3 is a transition radius 11 which prevents the formation of cracks at the outlet.

The dimension $y_{15}$ is approximately equal to the dimension Ø $x_{14}$, from which it may be seen that it is possible to achieve a very favorable ratio of the depth of the indentation to the width of the indentation. Depending on the application, the indentation can be used in a punctiform fashion or as a bead.

The invention is not limited by the embodiments described above which are presented as examples only but can be modified in various ways within the scope of protection defined by the appended patent claims.

We claim:

1. An indentation in a surface of a plastically deformable material, comprising:

an indentation depth at least equal to an indentation width;

a concave curved first section at a base of the indentation; and a second section adjoined to the curved first section in a direction of the surface so as to form a smooth continuous transition from the first section to the second section, the second section having a parabolic shape in cross section which parabolic shape has a greater gradient factor $m_2$ than a gradient factor m of the curved first section.

2. An indentation as defined in claim 1, wherein the parabolic second section is adjoined by a cylindrical third section in the direction of the surface.

3. An indentation as defined in claim 1, wherein the parabolic second section, at transitions to the first and third sections, in each case has a gradient equal to a gradient of the first and third sections, respectively.

4. An indentation as defined in claim 1, wherein the curved first section has a parabolic cross section at the base.

5. An indentation as defined in claim 1, wherein the indentation is of punctiform shape.

6. An indentation as defined in claim 1, wherein the indentation is a bead.

* * * * *